US005323568A

United States Patent [19]

Blomqvist

[11] Patent Number: 5,323,568

[45] Date of Patent: Jun. 28, 1994

[54] SWINGING ARM HOLD HAVING A LOCK FOR WINDOWS, SHUTTERS AND THE LIKE

[75] Inventor: Berthold B. R. Blomqvist, Lammhult, Sweden

[73] Assignee: Teknoskand Invent AB, Sweden

[21] Appl. No.: 834,298

[22] PCT Filed: Aug. 8, 1990

[86] PCT No.: PCT/SE90/00519

§ 371 Date: Feb. 18, 1992

§ 102(e) Date: Feb. 18, 1992

[87] PCT Pub. No.: WO91/02874

PCT Pub. Date: Mar. 7, 1991

[30] Foreign Application Priority Data

Aug. 25, 1989 [SE] Sweden ..... 8902843

[51] Int. Cl.[5] ..... E05D 15/28

[52] U.S. Cl. ..... 49/248; 49/394; 16/352

[58] Field of Search ..... 49/248, 250, 394; 16/252, 260, 388, 371; 292/120, 263

[56] References Cited

U.S. PATENT DOCUMENTS

| | | | |
|---|---|---|---|
| 3,479,766 | 11/1969 | Mecklin et al. | 49/394 X |
| 3,721,044 | 3/1973 | Kvasnes | 49/248 |
| 3,994,095 | 11/1976 | Hare | 49/394 X |
| 4,611,432 | 9/1986 | Lund et al. | 49/394 |
| 4,620,393 | 11/1986 | Stafset | 49/394 |
| 4,658,474 | 4/1987 | Anderssen . | |

FOREIGN PATENT DOCUMENTS

| | | |
|---|---|---|
| 460547 | 10/1989 | Sweden . |
| 1531391 | 11/1978 | United Kingdom . |

*Primary Examiner*—Peter M. Cuomo
*Assistant Examiner*—Jerry Redman
*Attorney, Agent, or Firm*—Davis, Bujold & Streck

[57] ABSTRACT

A swinging arm hold (8), designed to be attached between a window case (1) and a window frame (6) and comprising a basic bar (12), attached to the case, and an upper arm (11) and a lower arm (13), projecting from the ends of the basic bar, which two arms are rotatably attached to the uppermost part of an outer bar (9), which carries the frame. About the hinge between the basic bar and the upper arm a lock (18) having a lock recess (21) is mounted, rotatable in a limited way and designed to interact with a holding element (22), which projects from the lower arm. The lock recess is limited in its outermost part by guide surfaces (29, 30) for the holding element and its innermost part has an extension, which runs with an acute angle in relation to a line between any part of the recess and the swinging center (19) of the lock, mainly designed to, during the last part of the swinging movement of the frame, give the lock an idle position, which takes up less space, and allow the frame to occupy a somewhat further outwardly swung partially open position. From the disc-shaped lock an angled actuation means (35) projects outwards towards the center of the frame and constitutes one of the limits of a security recess (31), designed to limit the swinging movements of the lock.

16 Claims, 3 Drawing Sheets

Figure 1:
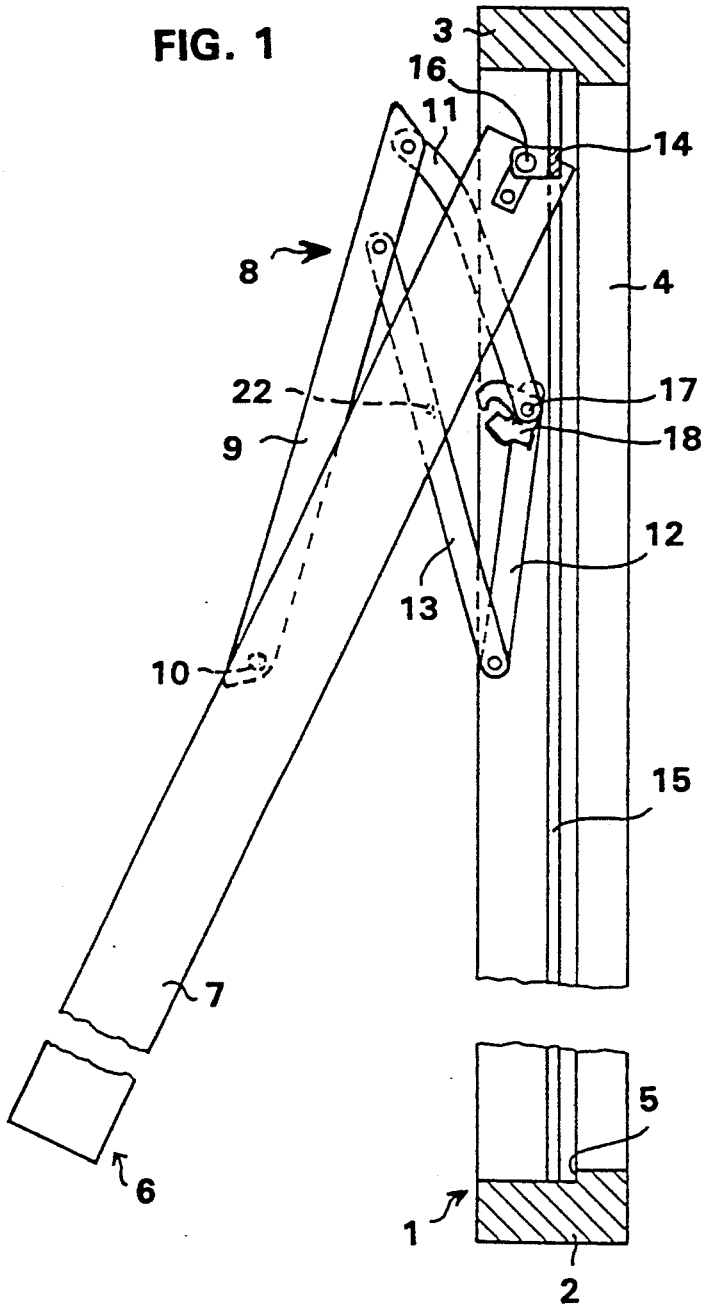

FIG. 3A
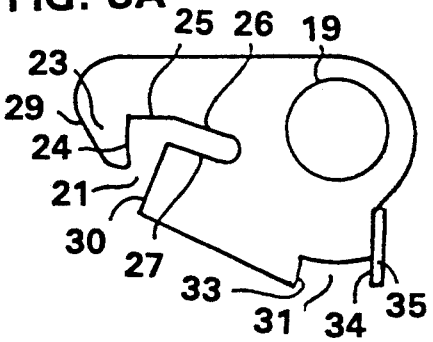
FIG. 3B
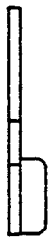
FIG. 3G
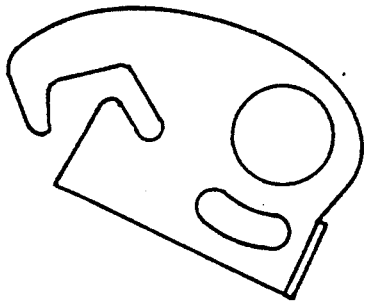
FIG. 3H
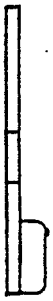
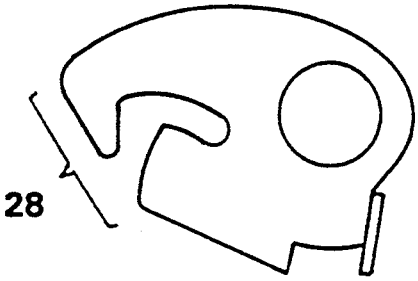
FIG. 3C
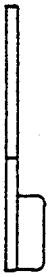
FIG. 3D
FIG. 3I
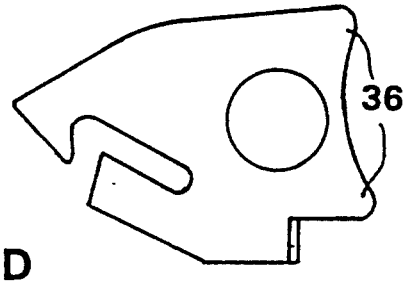
FIG. 3K
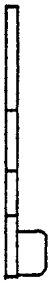
FIG. 3E
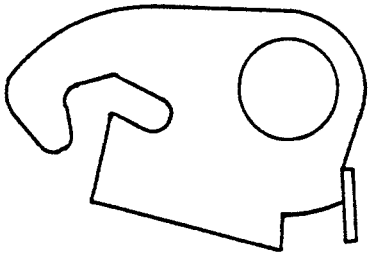
FIG. 3F
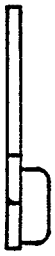
FIG. 5
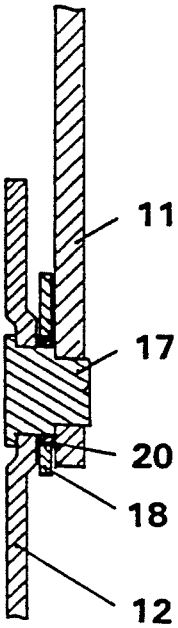
FIG. 3L
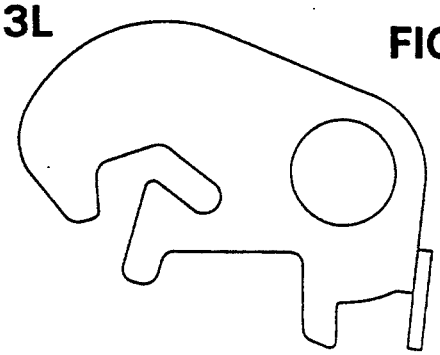
FIG. 3M
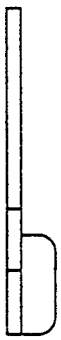

SWINGING ARM HOLD HAVING A LOCK FOR WINDOWS, SHUTTERS AND THE LIKE

The present invention relates to a swinging arm hold of the type set forth in greater detail in the preamble of patent claim 1.

Swinging arm holds provided with locks are already known, e.g. through SE B 380 863 and 441 201 as well as SE A 86050 02-8. A window frame can be swung open by means of such holds from a closed to a partially open position, in which a lock starts functioning and prevents the swinging movement from continuing to a larger opening angle. The purpose of the lock is principally to prevent children from falling out of a window. However, when cleaning windows, painting etc. it would be desirable to be able to open the window additionally or even swing the frame half a revolution, which is done by manually actuating the lock in such a way, that its locking element leaves its engagement position in relation to the hold, subsequent to which the frame can be swung, possibly in order to be locked anew in relation to the window case and the hold after having been swung half a revolution.

However, said already known holds are impaired by several shortcomings and inconveniences. Thus, the lock maybe is within too easy reach for children, who then are able to remove in a simple way the locking element from its locking position. The construction of the lock often does not allow any other more concealed position, and consequently such a lock and such a hold are entirely objectionable. Another risk maybe exists in the slow operation of the locking element or its tendency of being stuck in a clamp or friction position without starting its operation automatically. Also, the already known holds and locks are often comparatively complicated with a risk of functional disturbances because of this and with resulting production, assembly and mounting costs respectively, and it is probably necessary to produce the window frame and/or window case in a special way and subject them to supplementary treatments. A substantial risk of functional disturbances and also permanent damages may exist in the construction and the interaction of the swinging arm hold and the lock, the latter possibly being subjected to inappropriately large forces, e.g. lever arm forces, which may warp or permanently strongly wear down the locking element and particularly its vital parts. The locking element maybe is constructed in a wrong way ergonomicly seen, e.g. handicapped persons finding it difficult to actuate the lock and besides the lock, due to the way in which it is constructed, may require substantial opening forces. Finally, the already known locks are often completely inoperative, in case the window is brought into a position, which is not an absolutely vertical position. Also, it is not possible to turn the hold upside-down in such a way, that e.g. the upper part of a window frame will be swung out from the window case.

The object of the present invention principally is to, in all the above-mentioned respects, improve and develop the already known holds and locks, the described inconveniences and risks in this way being counteracted and being eliminated as far as possible. Another object of the invention is to in other respects develop the art in this field further and suggest a generally advantageous hold with a lock.

These objects are attained mainly by constructing, according to the present invention, a hold with a lock of the type described above.

Figure 2:
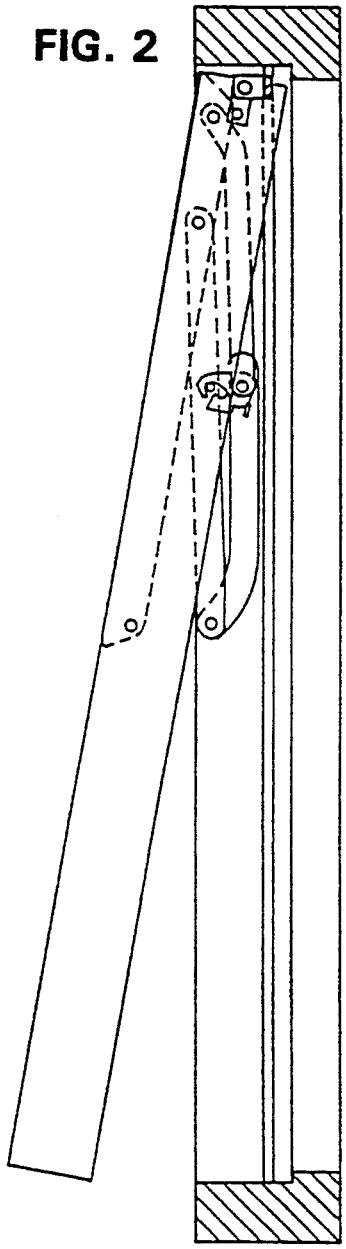

Additional characterizing features and advantages of the invention are set forth in the following description, reference being made to the accompanying drawings, which show a few preferred embodiments, which however are not limiting. The drawings show in detail:

FIG. 1 a window case in section with a frame having a swinging arm hold and a lock according to the invention in an open position after a release of the lock;

FIG. 2 a corresponding view of a hold, slightly modified, in a partially open position without or before a release of the lock;

FIG. 3 *a*)–*m*) various lock means according to the invention in plan and lateral views;

FIG. 4 *a*)–*d*) partial views of a hold and a lock according to the invention in successive operative positions;

FIG. 5 a sectional view along line A—A in FIG. 4 d); and

FIG. 6 *a*)–*d*) views, which correspond to FIGS. 4 *a*)–*d*), of a slightly modified lock.

In FIG. 1 a window case is designated 1 having a lower part 2, an upper part 3 and two lateral parts 4. All their sides, facing each other, are provided with a stop edge 5, against which a window frame 6 is designed to bear. Each one of lateral parts 7 of frame 6 is provided with a swinging arm hold 8, which holds are designed in a mirror-symmetrical fashion and suitably are recessed in case 1 in recesses, not shown, e.g. milled-out portions. Each hold comprises 4 arms, bars or the like, namely an outer bar 9, which, when the window is closed, can be substantially aligned with the exterior upper half of the frame side and is rotatably attached to the frame by means of a pivot 10, inserted into the frame, roughly in the middle of the frame at the lower part of the bar. The upper end of bar 9 is rotatably attached to the upper end of an upper arm 11, the other lower end of which is rotatably attached to the upper end of a basic bar 12, stationarily attached to the case, at the lower end of which the lower end of a lower arm 13 is rotatably attached, the upper end of which is rotatably attached to the upper part of outer bar 9, somewhat below the attachment of upper arm 11.

The outer bar and the lower arm suitably always are straight, but the basic bar and/or the upper arm can be bent in various ways. The upper arm preferably always is slightly bent, but the basic bar can be straight or bent according to FIG. 2. The outer long edge of the outer bar suitably is angled (not shown) in order to shield and protect the hold outwardly.

Frame 6 is, besides its mounting on the hold on its pivot 10, also guided in the case by means of a runner 14, which is guided in a groove 15, which is made in lateral parts 4 and extends along all their height. Because of the different angular positions of the frame in relation to the case runner 14 is attached to the frame via pivot means 16.

Preferably between the basic bar and the upper arm a lock 18 is rotatably mounted about their common hinge 17 and this lock is mainly disc-shaped with a transverse bore hole 19 in order to be mounted about hinge 17, which suitably is a shouldered rivet, a spacer 20 possibly being provided between the hinge and the wall of the bore hole, which is slightly larger in diameter, in order to obtain a smoother rotation of the lock, the spacer possibly for this purpose also being slightly thicker than the lock, thus avoiding a binding of the lock, when the hinge is attached, e.g. by means of riveting.

The lock is also provided with a lock recess 21, which is open mainly towards lower arm 13, to which a laterally projecting holding element 22 is attached, e.g. a tubular rivet or a solid rivet, which possibly is provided with a head (not shown) in order to avoid that the lock unintentionally is released from the lower arm in a lateral direction. The lock recess can be designed in various ways, which are shown in FIG. 3. All the shown lock recesses have that in common that they are limited by a lock hook 23 on that side, which faces holding element 22, side 24 of lock hook 23, which faces the lock recess, being designed to hold holding element 22, when the frame is swung outwards into its partially open position according to FIG. 2. For this purpose side 24 preferably will be placed in an angular position in relation to the frame or the outer bar, which roughly corresponds to an extension along a circular arc, which is concentric with bore hole 19. Side 24 is straight or possibly slightly concave, and in this way it can be efficiently prevented that the lock unintentionally slides away from the holding element.

Figure 4D:
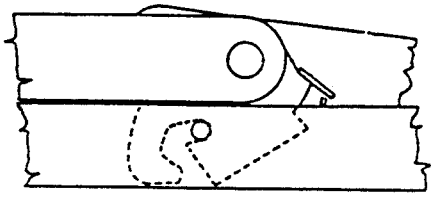
Figure 4C:
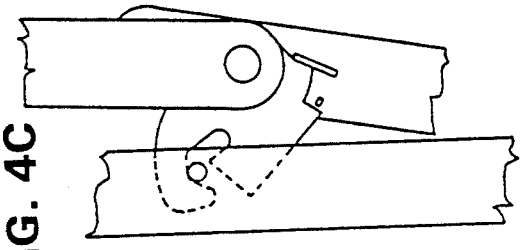
Figure 4B:
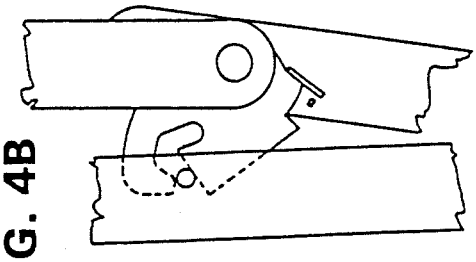
Figure 4A:
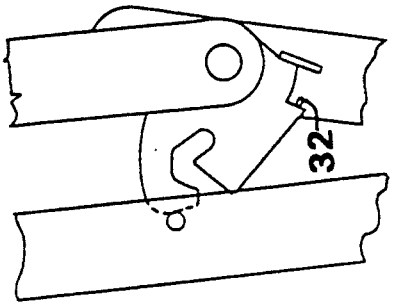
Figure 6D:
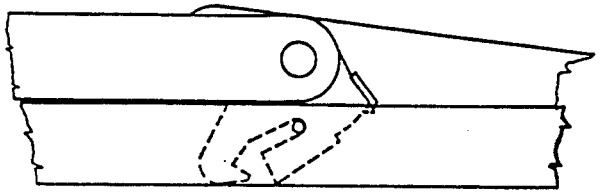
Figure 6C:
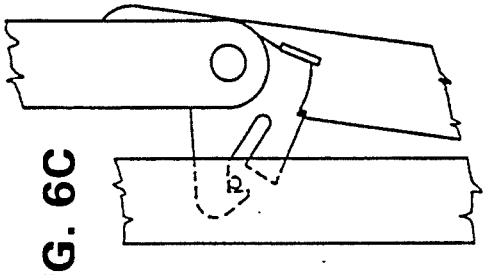
Figure 6B:
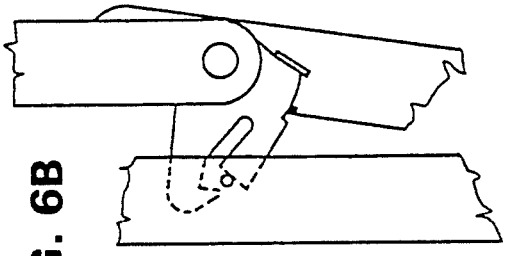
Figure 6A:
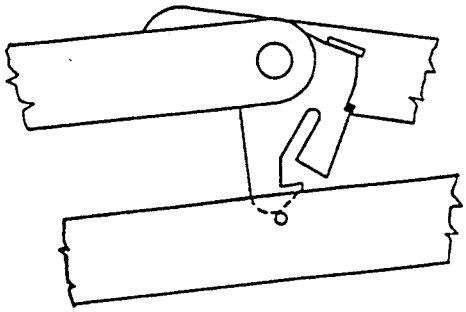

Adjacent to side 24 the recess forms at the same side, possibly via a short straight part 25, an inclined side 26, which deviates from a line between rotation center 19 and the lock position according to FIG. 2, which positively guides the lock into a rotation movement in clockwise direction in FIG. 2, which is clearly shown in FIG. 4*c*) and *d*), until the holding element reaches its end position in the innermost end of the recess, which means that the frame now is completely recessed in the window case and consequently that the window is closed, and consequently the slightly oblong lock has been rotated from a position, which takes up a great deal of space and projects with a more obtuse angle from the basic bar, to a position, which takes up less space and projects with an acute angle from the basic bar. Thus, sides 24,25 and 26 are important primarily when the frame is moved from a partially open to a completely closed position. In the opposite direction preferably just one side is important, which is designated 27 and mainly is situated opposite to side 26. Side 27 slides, when the frame is opened up, towards the holding element and brings the lock back to that position, which projects more markedly from the basic bar, provided the lock is not, because of the gravity, supported with its side 26 by the holding element, until the holding element either via a free movement reaches directly from the outermost end of side 27 side 24 or because of the gravity via side 26 and 25 reaches the same end position. This means that the functioning of the lock is secured irrespective of whether the gravity is operative or is inoperative because of friction or other factors. The lock is mounted according to the invention in such a way, that part 28, shown in FIG. 3 *a*) at any rate is exposed to the holding element, when the frame is moved from a completely open position to an engagement with the lock. The holding element suitably hits exterior side 29 of lock hook 23, which side is inclined in relation to a line between rotation center 19 and the holding element in said contact position, more precisely inclined in a direction inwards towards recess 21. In this way the lock will, when the frame is moved further inwards, be rotated in clockwise direction in FIG. 4 *a*), until the holding element hits a preferably straight side 30, which is connected with an angle of between 120 and 60 degrees, preferably about 90 degrees, to side 27. Side 30 subsequently slides along the holding element and rotates the lock additionally in clockwise direction, until the holding element slides into that portion of the recess, which is limited by sides 26 and 27, in which portion an automatic locking according to the description supra takes place. In case the holding element directly hits side 30, e.g. when the friction is inappropriate, the same will nevertheless be positively guided into its end position according to the description supra.

In order to guarantee that the holding element will always hit a point along part 28, the lock is, according to a preferred embodiment, within the area of the interior side of the frame in a partially open position provided with a security recess 31, which interacts with a stop 32, which projects from the basic bar. One end side 33 of recess 31 engages in the position shown in FIG. 4 *a*) the stop in such a way that the holding element is able to hit side 29. The other end side 34 of recess 31 is designed to guarantee, that the holding element cannot hit a point outside side 30, and suitably is formed by an actuation element 35, which is designed to be actuated manually in order to rotate the lock out of its engagement with the holding element. A portion of window case 1, e.g. stop edge 5, can as an alternative perform the functioning of security recess 31 and portions interacting with this recess completely or partially. Thus, the lock according to FIG. 3 *i*), *k*) is on that side which is opposite to recess 21 provided with projections 36, projecting from recess 21, which are designed to hit the window case and in this way define rotation limitations for the lock, corresponding to recess 31 etc. However, also in this case an actuation element 35 can be used, which consequently in all cases projects from the plane of the lock inwards towards the center of the frame in such a way, that it is possible to grip this element, which however is positioned comparatively high up on side 4 of the frame and carefully concealed (see FIG. 2) in such a way, that it is positioned outside the normal reach of children and is difficult to detect because of its minor cross-section or end surface. In FIG. 3*g* recess 31 is completely enclosed in the lock.

I claim:

1. A locking swinging window hinge comprising:

a) a window frame;

b) a window casement;

c) a pair of pivot mountings attached to the inside of either side of said casement and pivotally mounting said window casement in said window frame; each of said pivot mountings comprise, an upper arm, a lower end of said upper arm being pivotably attached to a stationary common hinge having an outer diameter and mounted on the inside of said window frame; an outer bar, an upper end of said outer bar being pivotably connected to an upper end of said upper arm; a basic bar, an upper end of said basic arm being pivotably connected to said common hinge; a lower arm, a lower end of said lower arm being pivotably connected to a lower end of said basic bar, an upper end of said lower arm being pivotably connected to an upper part of said outer bar below the connection of said upper arm to said outer bar; a lower end of said outer bar being pivotably attached to said window casement approximately half way up the side of said casement such that when said window is closed, each of said pivot mountings are in line with an upper half of the window casement; a lock rotatably mounted on said common hinge; and a holding element having a diameter and projecting laterally from said lower arm;

d) wherein a lock recess defined by said lock interacts with said holding element; and e) said lock recess has i) a first part that forms an opening in a lower side of said lock such that said lock falls onto said holding element when said opening is brought into alignment with said holding element by swinging the window casement outwardly away from said window frame or inwardly toward said window frame thereby locking said window casement in a desired partially opened position and ii) a second part having sides extending from the inner most part of said opening toward said common hinge at an acute angle to a line that runs between any part of said lock recess and said common hinge, such that the sides of the second part of said lock recess form upper and lower guide surfaces that interact with said holding element upon closing the window casement in said window frame such that said lock is rotated to an idle position when said window casement is closed, such that said lock takes up less space in the idle position than it does in a locked position and a longer lock may be used to hold said window casement in a greater opened position with the same size window frame.

2. An apparatus as in claim 1, wherein at least one of the upper end of said upper arm and the lower end of said basic bar are configured such that upon closing said window casement in said window frame said lower arm and said outer bar are substantially parallel and spaced from said upper arm and said basic bar.

3. An apparatus as in claim 1, wherein said lock is generally disc shaped, a transverse through hole passes through said lock to receive said common hinge therein and to rotatably mount said lock on said common hinge;

a cylindrical spacer having an inner diameter that is larger than the outer diameter of said common hinge and is mounted in said through hole to ensure smooth rotation of the lock on said common hinge.

4. An apparatus as in claim 3, wherein said spacer is thicker than the lock in order to ensure smooth rotation of said lock on said common hinge.

5. An apparatus as in claim 1, wherein said lock is mounted on said common hinge in between said basic bar and upper arm.

6. An apparatus as in claim 1, wherein the first and second parts of said lock recess are limited on their outer most side opposite said through hole by a lock hook, an inner side of said lock hook that faces the lock recess is longer than the diameter of said holding element in order to retain said holding element within said recess and thereby lock the window casement in said particularly partially rotated open position.

7. An apparatus as in claim 6, wherein at least a portion of the inner side of said lock hook substantially extends along a circular arc concentric to said through hole.

8. An apparatus as in claim 7, wherein the radius of the arc portion of the inner side of locked hook is larger than the radius of said holding element.

9. A locking window comprising:

a window case;

a window frame having two lateral sides, an upper side and a lower side;

a pair of pivot mountings, one pivot mounting mounted on the interior of each of said lateral sides for pivotably mounting said window frame in said window case;

a pair of swinging arm mechanisms one being attached to each of said lateral sides, each of said swinging arm mechanisms comprising:

an upper arm having first and second ends, said second end of said upper arm being pivotably attached to a stationary common hinge mounted on the inside of said window case;

an outer bar having first and second ends, first end of said outer being pivotably connected to the first end of said upper arm and the second end of said outer bar being pivotably attached to said window frame;

a basic bar having first and second ends, first end of said basic bar being pivotably connected to said common hinge;

a lower arm having first and second ends, the second end of said lower arm being pivotably connected to the second end of said basic bar, the first end of said lower arm being pivotably connected to the first end of said outer bar;

a lock rotatably mounted on said common hinge;

a recess in said lock, said recess having an inner portion formed by opposing guide surfaces, and an outer portion formed by an opening on a side of said lock such that gravity causes said holding element to enter said outer portion when said outer portion is brought into alignment with said holding element, said inner and outer portions are each formed about a separate axis such that the axes form an acute angle along said recess, and said lock will rotate approximately 90° clockwise when said window is moved from a locked partially opened position to a locked fully closed position while simultaneously said holding element is moved from said outer portion to an inner most portion of said end portion while said lock is rotated.

10. An apparatus as claimed in claim 9, wherein at least one of the first end of said upper arm and the second end of said basic bar are configured such that upon closing said window frame in said window case, said lower arm and said outer bar are substantially parallel.

11. An apparatus as claimed in claim 9, wherein said lock is generally disc shaped and further comprises:

a transverse through hole passing through said lock to receive said common hinge therein and to rotatably mount said lock on said common hinge;

the cylindrical spacer having an inner diameter that is larger than the outer diameter of said common hinge wherein said cylindrical spacer is mounted in said through hole to ensure smooth rotation of the lock on said common hinge.

12. An apparatus as claimed in claim 9, wherein said outer portion is partially formed by a lock hook which prevents said holding element from leaving said recess when the locking window is in a locked position.

13. An apparatus as claimed in claim 12, wherein at least a portion of an inner side of said lock hooks substantially extends along a circular arc concentric to said through hole.

14. An apparatus as claimed in claim 13, wherein said holding element is cylindrical and the radius of the arc portion of the inner side of the lock hook is larger than the radius of said holding element.

15. An apparatus as claimed in claim 12, wherein said holding element is cylindrical and lock hook is longer than the diameter of said holding element so that an inner side of said lock hook retains said holding element within said recess when the window frame is swung outward or inwards to a locked partially opened position.

16. An apparatus as claimed in claim 15, wherein at least a portion of an inner side of said lock hook substantially extends along a circular arc concentric to said through hole.

* * * * *